US006435675B2

(12) United States Patent
Okura et al.

(10) Patent No.: US 6,435,675 B2
(45) Date of Patent: Aug. 20, 2002

(54) METHOD FOR MANUFACTURING INK TANK, INK TANK, INK JET CARTRIDGE, AND INK JET RECORDING APPARATUS

(75) Inventors: Akinori Okura; Tadashi Makiguchi, both of Yokohama; Tsutomu Abe, Isehara; Toshimitsu Nakamura, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/788,535

(22) Filed: Feb. 21, 2001

(30) Foreign Application Priority Data

Feb. 22, 2000 (JP) ..... 2000-044537

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | |
|---|---|---|---|
| 5,400,067 A | 3/1995 | Day | 347/87 |
| 5,619,238 A | 4/1997 | Higuma et al. | 347/86 |
| 5,903,294 A | 5/1999 | Abe et al. | 347/87 |

FOREIGN PATENT DOCUMENTS

| | | |
|---|---|---|
| EP | 0 520 695 | 12/1992 |
| EP | 0 842 780 | 5/1998 |
| JP | 5-463 | 1/1993 |
| JP | 7-125232 | 5/1995 |
| JP | 7-314727 | 12/1995 |
| JP | 8-230209 | 9/1996 |

*Primary Examiner*—Anh T. N. Vo
(74) *Attorney, Agent, or Firm*—Fitzpatrick, Cella, Harper & Scinto

(57) ABSTRACT

A method for manufacturing an ink tank comprises the steps of supplying a container having an opening, inserting a porous member into the opening of the container in a compressed state, and holding the porous member in the compressed state by fixing a plate member to the opening of the container. The porous member is compressed more in a direction substantially orthogonal to the direction of the insertion into the opening. When compressing the porous member, the porous member is clamped in the same direction as the inserting direction so as not to allow the porous member to be deformed in the inserting direction, and in such state, the porous member is compressed in directions substantially orthogonal to the inserting direction.

9 Claims, 17 Drawing Sheets

METHOD FOR MANUFACTURING INK TANK, INK TANK, INK JET CARTRIDGE, AND INK JET RECORDING APPARATUS

BACKGROUND OF THE INVENTION

1. Field of the Invention

The present invention relates to a method for manufacturing in an ink tank that retains ink for use in ink jet recording. Also, the present invention is applicable to a copying machine, recording equipment, such as a facsimile machine, communication equipment, office equipment, complex equipment, a printer, and the like that uses the ink jet technologies.

Here, in the specification hereof, the term "recording" means forming not only meaningful images, such as characters, but also meaningless images, such as patterns. The recording equipment includes all kinds of information processing apparatuses or the printer that serves as the output equipment thereof.

2. Related Background Art

As the output equipment of a personal computer, a copying machine, a facsimile, or the like, a recording apparatus of ink jet type is used. As one example of recording means applicable to an ink jet recording apparatus of the kind, there is an ink jet cartridge in which an ink jet recording head is integrally formed with an ink tank that retains ink to be supplied to the ink jet recording head, which is arranged to be exchangeable with respect to the scanning carriage provided for the apparatus.

The ink tank of an ink jet cartridge has in the interior thereof a negative pressure generating element retaining ink therein, which is arranged to exert a desired negative pressure with respect to the recording head. Here, as a structure capable of using contained ink without waste, while exerting appropriate negative pressure as an ink tank, there is disclosed a structure in the specification of Japanese Patent Laid-Open Application No. 07-125232, for example, wherein the interior of the ink tank is divided into almost halves by use of a wall member, and then, a communicative portion is provided between the separation wall and the bottom thereof to supply ink, while a porous member is contained in a chamber (a first container chamber) on the side where the recording head is installed, and ink is directly contained in the other chamber (a second container chamber).

Further, in the specification of Japanese Patent Laid-Open Application No. 08-230209 filed by the applicant hereof, a structure is made applicable to an ink jet cartridge having a recording head provided integrally therefor so as to be more adaptable for change of postures in the delivery distribution, as well as for the environmental changes.

SUMMARY OF THE INVENTION

As described above, the applicant hereof has proposed the ink tank structure which is excellent in demonstrating the capability of stable ink supply against the condition of delivery distribution and environmental changes. For the sufficient demonstration of such function of the tank, the following aspects are taken into consideration for the implementation thereof.

In other words, the shape of the first container chamber is such that the dimension in the directions substantially in parallel is made larger than the dimension in the direction orthogonal to the structural plane of the partition plate to be fused and bonded so that the area of the porous member contained in the first container chamber, which exists between the fine communicative portion and the ink supply port connected with a recording head, is easily compressed more than the other area. Moreover, with the structure in which the first container chamber is formed by fusing and bonding the partition plate after the porous member has been contained in the tank container, the contained porous member is in such a configuration that it is scarcely compressed in the direction orthogonal to the structural plane of the partition plate, that is, the restoring force of the compressed porous member does not work greatly in the direction in which the fusion bonded partition plate is compressed to the ink containing chamber side. As a result, the compressivity of the contained porous member is made greater in the direction substantially parallel to the structural plane of the partition plate so as to exert negative pressure with respect to the ink jet recording head.

Along with this arrangement, the porous member is in such a shape before compression that the dimension thereof in the direction of its insertion into the tank container is extremely small as compared with the one in the direction orthogonal to the inserting direction.

However, when the porous member is compressed in the direction orthogonal to the inserting direction at the time of being inserted into the tank, there is a possibility that the compressed porous member is folded right on the center thereof, because the dimension of the porous member is smaller in the direction of insertion than the one in the direction orthogonal to the inserting direction before being contained in the tank. As a result, it becomes difficult to insert the porous member into the tank container in good condition.

With a view to solving the problems encountered in the manufacture of tank as described above, it is the main object of the invention to provide a method for manufacturing an ink tank capable of containing in a tank container a porous member of such a shape that the dimension thereof is extremely large in the direction orthogonal to the direction of insertion into the container as compared with the dimension in the inserting direction by exerting compression greatly on the dimension in the direction orthogonal to the inserting direction, while scarcely exerting compression on the dimension in the inserting direction so as to obtain appropriate compression for generating negative pressure in the tank container.

Also, it is another object of the invention to provide a method for manufacturing an ink tank capable of maintaining the ink supply capability stably irrespective of the condition of delivery distribution and the environmental changes.

It is still another object of the invention to provide an ink tank manufactured by the method of manufacture described above, an ink jet cartridge provided with such ink tank, and an ink jet recording apparatus having such ink tank mounted thereon.

In order to achieve the above objects, the method of the present invention for manufacturing an ink tank comprises the steps of supplying a container having an opening; inserting a porous member into the opening of the container in a state of being compressed; and holding the porous member in the compressed state by fixing a plate member to the opening of the container, and the porous member being in a compressed shape more in the direction substantially orthogonal to the direction of the insertion when the porous member is compressed in the inserting direction into the opening. In this method, when compressing the porous member, the porous member is clamped in the same direction as the inserting direction so as not to allow the porous member to be deformed in the inserting direction, and in such state, the porous member is compressed in the direction substantially orthogonal to the inserting direction.

Further, when fixing the plate member to the opening, the porous member inserted into the opening should preferably be pushed in once.

The porous member is in a shape of flat rectangular parallelepiped having small dimension in the inserting direction as compared with the dimension in the direction substantially orthogonal to the inserting direction into the opening, and the dimension of the porous member in the inserting direction is slightly larger than the dimension of the opening in the inserting direction.

It is preferable to compress the porous member more in the direction X than the direction Y when the dimension of the porous member of flat rectangular parallelepiped is larger in the direction Y than the dimension in the direction X in the two axial X and Y directions orthogonal to the inserting direction.

Also, for the ink tank which is used for the method of manufacture described above, the plate member is a partition plate for dividing the interior of the container into a first container chamber and a second container chamber, and the porous member is contained in the first container chamber; the first container chamber is provided with an ink supply port arranged on the plane facing the partition plate, and an atmosphere communication port; the partition plate is provided with a fine communicative portion in the area facing substantially to the ink supply port; and the area of the porous member existing between the ink supply port and the fine communicative portion is held in higher compression than the other area.

Also, the present invention further encompasses the ink jet cartridge, which comprises an ink jet head being bonded to the ink supply port of the ink tank referred to in the preceding paragraph.

For the aforesaid ink jet head, it is applicable to adopt the one which is provided with electrothermal converting devices to generate ink discharge energy for discharging ink from the discharge ports by utilization of film boiling created in ink by thermal energy applied by the electrothermal converting devices.

Also, the present invention includes the ink jet recording apparatus provided with an ink jet cartridge which is made detachably mountable on the recording apparatus main body.

In accordance with the present invention, it is arranged to clamp the porous member in the inserting direction so as not to allow the porous member to be deformed in the inserting direction when inserting it into the container, and in this state, the porous member is compressed in the direction substantially orthogonal to the inserting direction. Therefore, even if the dimension of the porous member is sufficiently small in the inserting direction before compression as compared with the one in the direction substantially orthogonal to the inserting direction, there is no possibility that the compressed porous member is folded right on the center thereof, hence making it possible to insert it into the tank container in good condition.

Also, after the porous member has been inserted into the container in a state of being compressed, the porous member is pushed in once during the period until the plate member is fixed to the opening of the container, hence preventing the porous member from being expanded and folded, to make it possible to obtain appropriate compression in the porous member thus contained.

DETAILED DESCRIPTION OF THE PREFERRED EMBODIMENTS

Hereinafter, with reference to the accompanying drawings, the description will be made of the embodiments in accordance with the present invention.

Figure 16A:
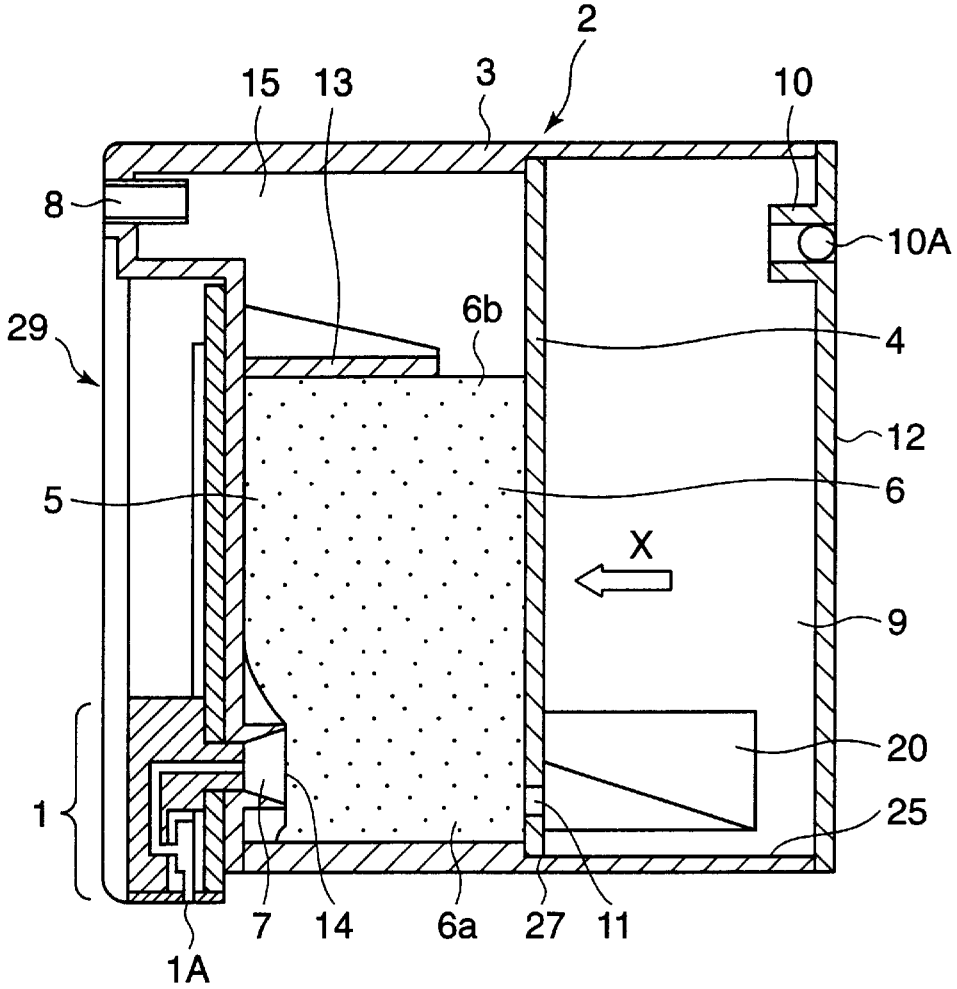
FIG. 16A is a cross-sectional view which shows the structure of the ink tank to which the method of manufacture of the present invention is applicable.

At first, while describing the ink tank to which the method of the present invention for manufacturing an ink tank is most preferably applicable, the background art will be described with respect to the porous member inserted into such ink tank. FIG. 16A is a cross-sectional view which shows the ink jet cartridge to which the method of the present invention for manufacturing an ink is most preferably applicable.

Figure 16B:
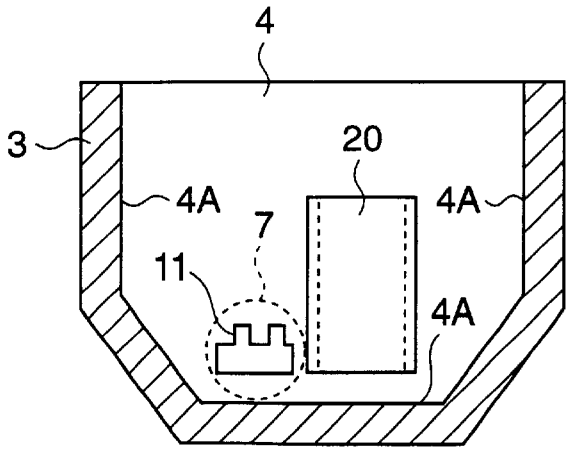
FIG. 16B is a view observed in the direction indicated by an arrow X in FIG. 16A.

FIG. 16B is a view which shows in enlargement the portion observed in the direction X indicated by an arrow in FIG. 16A.

In accordance with FIGS. 16A and 16B, the ink jet cartridge is divided into the ink jet unit 29 provided with an ink jet recording head 1, and the ink tank unit 2 which contains ink to be supplied to the ink jet unit 29. Here, the ink tank unit 2 comprises a tank container 3, a covering member 12, and a partition plate 4. Then, the structure is arranged to be divided by the partition plate 4 into a first container chamber porous member containing portion) 5, and a second container chamber (ink containing chamber) 9. The first container chamber 5 contains a porous member 6, such as a sponge or urethane foam, in compressed condition. This chamber is provided with an atmosphere communication port 8 through which the air outside is supplied to the porous member 6, and an ink supply port 7 through which ink absorbed in the porous member 6 is supplied to the ink jet recording head 1. For the ink supply port 7, a filter 14 is provided in order to remove dust particles in the ink tank 2.

There is a buffer chamber 15 between the atmosphere communication port 8 and the porous member 6. The buffer chamber 15 is formed by a pressure plate 13 that compressively holds the porous member 6. Also, the pressure plate 13 is made functional to keep the porous member 6 in a desired position in the first container chamber 5.

On the position of the partition plate 4 that faces the ink supply port 7 substantially, there is provided a fine communicative portion 11 that penetrates the partition plate 4, and this fine communicative portion 11 is arranged to be away from the boundary 4A between the inner walls of the tank container 3 and the partition plate 4.

The second container chamber 9 is communicated with the first container chamber 5 by way of the fine communicative portion 11, and contains only ink to be supplied to the first container chamber 5. Ink is injected into the second container chamber 9 through the ink filling port 10 formed on the cover member 12. After the injection of ink, the ink filling port 10 is sealed with an SUS ball 10A in order to prevent ink leakage from the ink injection port 19 (FIG. 16A shows schematically the ink jet cartridge having no ink contained therein).

In this respect, the cover member 12 is formed by transparent material, and at the same time, a reflection plate 20 is arranged on the partition plate 4 on the second container chamber 9 side as means for detecting ink remains to sense the presence of ink optically.

With the structure thus arranged, the area 6a of the porous member 6 contained in the first container chamber 5 in a state of being compressed, which is squeezed between the fine communicative portion 11 and the ink supply port 7, is compressed more than the other area 6*b,* because the circumference of the ink supply port 7 protrudes to the first container chamber 5 side. As a result, ink in the second container chamber 9 is directly induced from the fine communicative portion 11 to the highly compressed area 6*a*, that is, the area having a large capillary force, and then, guided to the ink supply port 7 as it is. Owing to this arrangement, it becomes possible to secure the ink passage stably between the ink containing unit and ink supply port irrespective of the posture in distribution for delivery and storage, or the environmental changes. Also, with the filter 14 provided for the opening portion of the ink supply port 7 in the form of being in contact with the porous member 6 under pressure, meniscus is formed on the filter portion so as to trap micro bubbles which are liable to be supplied from the porous member 6 together with ink. This contributes to making the aforesaid arrangement more effective. In addition, the buffer chamber 15 is formed with the space inside the first container chamber 5 in the vicinity of the atmosphere communication port 8 so as not to allow the atmosphere communication port 8 to be in contact with the porous member 6, hence providing an advantage that ink leakage from the atmosphere communication port 8 is prevented more reliably. Moreover, even if there is fluctuation in the environmental condition, it becomes possible to prevent ink in the ink tank from leaking through the atmosphere communication port 8.

Also, when manufacturing such an ink tank unit as described above, the porous member 6 is incorporated in the compressed condition from the opening 25 side of the tank container 3 after the filter 14 has been fixed to the ink supply port 7. Then, the partition plate 5 is also incorporated from the opening 25 side of the tank container 3, and fused on a designated position of the inner side of the tank container 3, thus arranging the structure of the first container chamber 5. Then, the opening 25 of the tank container 3 is sealed with the cover member 12 to arrange the structure of the second container chamber 9. Further, subsequent to having injected ink into the second container chamber 9 through the ink filling port 10 of the cover member 12, the ink filling port 10 is closed by use of the SUS ball 10A, hence completing the ink tank unit of the ink jet cartridge.

Here, for the aforesaid ink jet cartridge, the shape of the first container chamber is such that the dimension thereof related to substantially parallel direction is larger than the dimension related to the direction orthogonal to the structural surface of the partition plate thus fused. Moreover, the contained porous member is configured so as to be scarcely compressed in the direction orthogonal to the structural surface of the partition plate. Then, in order to exert negative pressure with respect to the ink jet recording head, the compressibility of the porous member to be contained is made larger in the direction substantially parallel to the structural surface of the partition plate.

Figure 17:
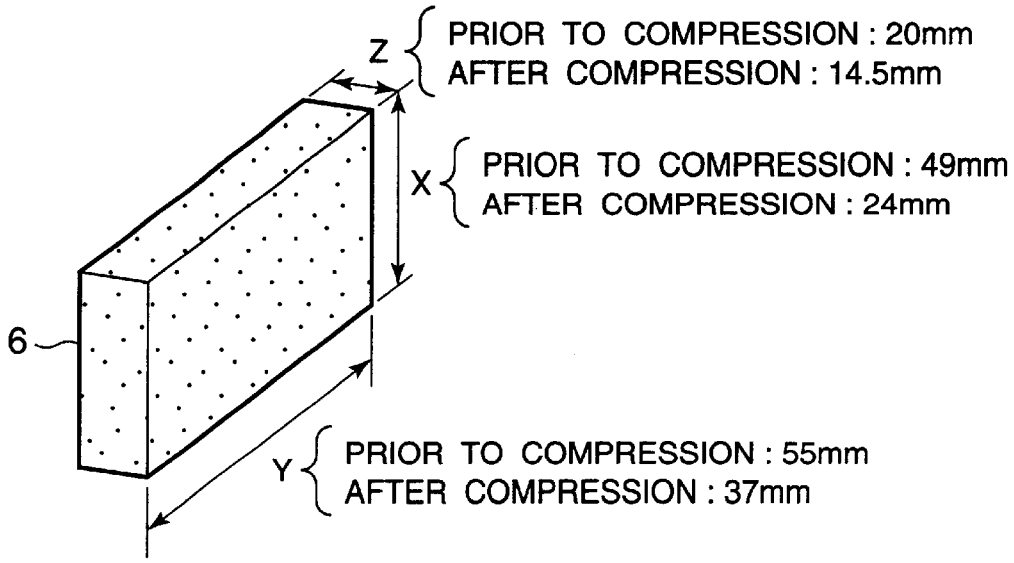
FIG. 17 is a perspective view which shows the shape of the porous member which serves as the negative pressure generating member for the ink tank to which the method of manufacture of the present invention is applicable.

Therefore, before insertion, the dimension of the porous member used for the aforesaid ink tank is extremely small in the insertion direction as compared with the dimension thereof in the direction orthogonal to the direction in which the member is inserted into the tank container. As shown in FIG. 17, for example, if the shape of the porous member is flat rectangular parallelepiped, the dimensions X, Y in the direction orthogonal to the insertion direction of the porous member before compression are 49 mm (24 mm after insertion) and 55 mm (37 mm after insertion) respectively. Then, the dimension Z in the insertion direction is as extremely small as 20 mm (14.5 mm after insertion) as compared with the dimensions X and Y.

Figure 18:
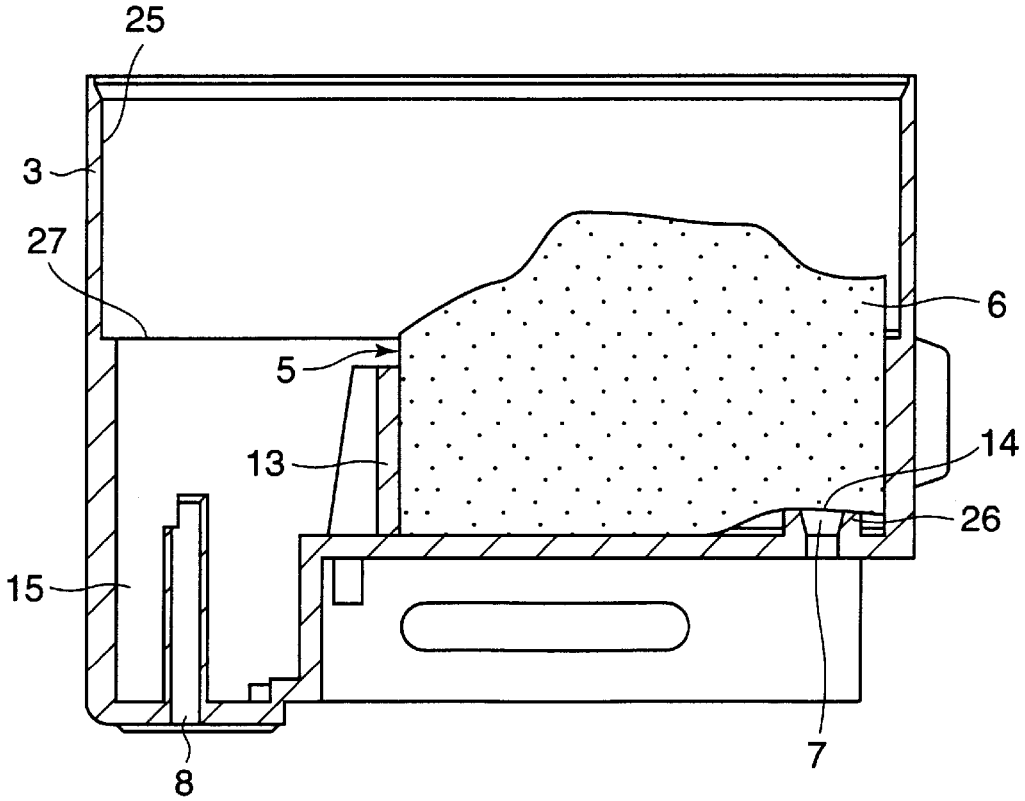
FIG. 18 is a cross-sectional view which shows the tank for the illustration of problems related to the manufacture of the ink tank represented in FIGS. 16A and 16B.
Figure 19:
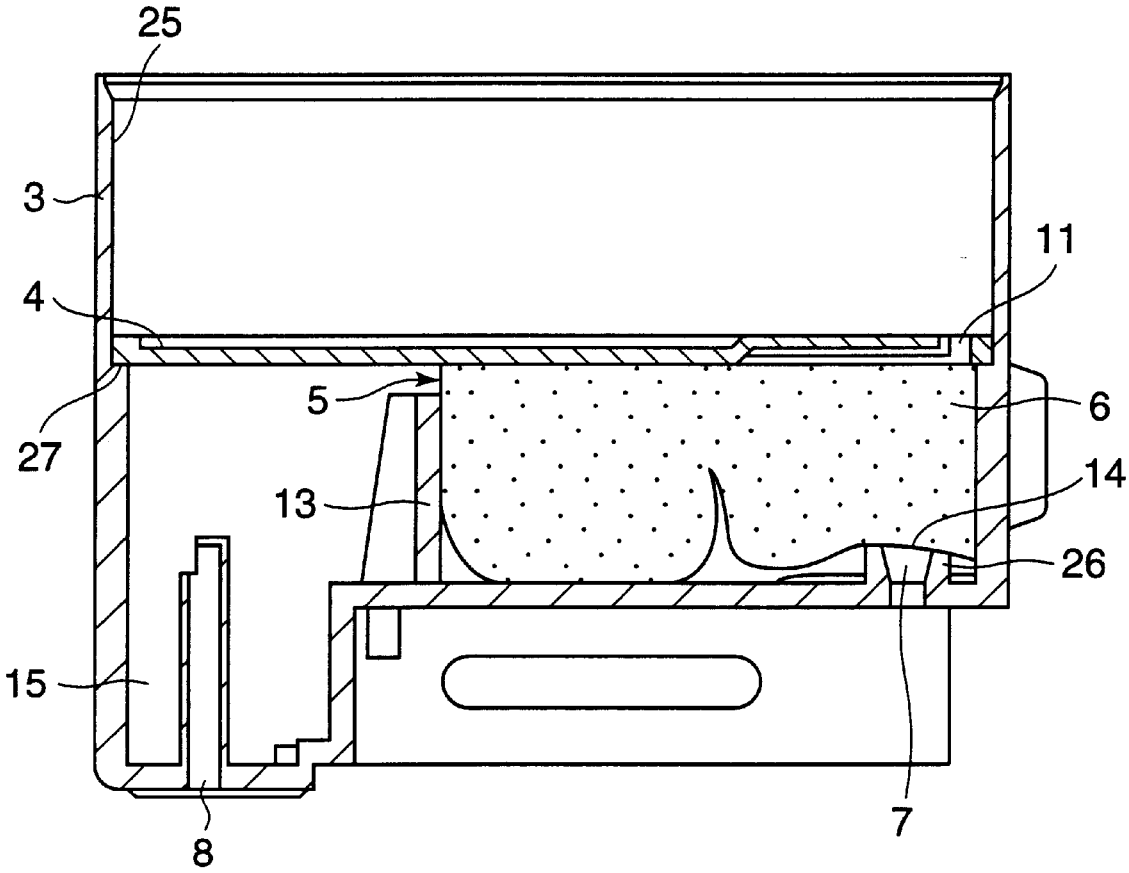
FIG. 19 is a cross-sectional view which shows the tank for the illustration of problems related to the manufacture of the ink tank represented in FIGS. 16A and 16B.

However, if the porous member is compressed in the direction orthogonal to the direction of tank insertion at the time of the tank being inserted, it is possible for the compressed porous member to become zigzag, creased or pinched right on the center thereof, because the dimension of the porous member in the insertion direction is smaller than its dimension in the insertion direction before being contained. Also, even if the porous member is compressed in good condition and contained in the tank container, the center of the porous member tends to rise due to the configuration of the porous member as described above until the partition plate is fused and bonded. If the central portion of the porous member should become zigzag, creased or pinched before the partition plate is fused and bonded in the tank container as shown in FIG. 18, the zigzag condition remains unchanged even after the partition plate has been fused and bonded as shown in FIG. 19. As a result, it becomes impossible to obtain any appropriate compression which enables the area existing between the fine communicative portion and the ink supply port to be compressed more than the other areas in the contained porous member.

Figure 1:
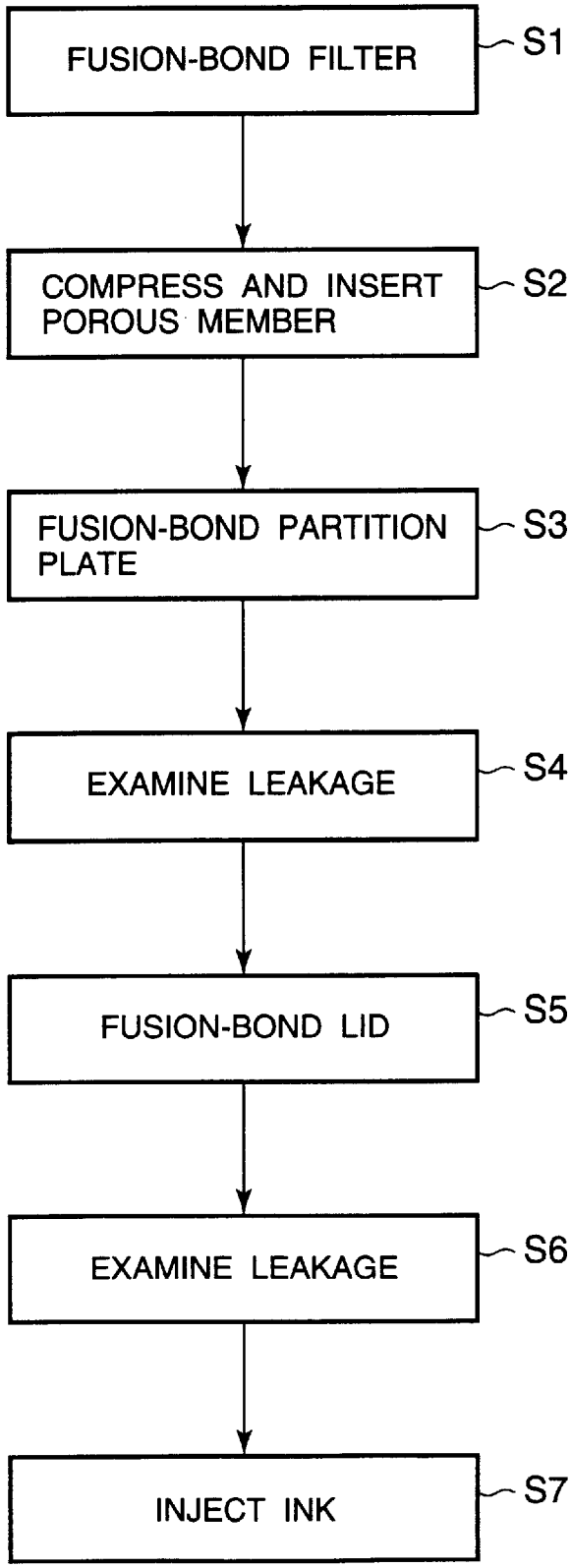
FIG. 1 is a flow diagram which shows a method for manufacturing an ink tank in accordance with one embodiment of the present invention.

Now, in conjunction with FIG. 1, the description will be made of the method for manufacturing an ink tank in accordance with the present invention. FIG. 1 is a view which shows the process flow of the method for manufacturing an ink tank in accordance with one embodiment of the present invention.

For the manufacture of the ink tank unit shown in FIGS. 16A and 16B, there are roughly the steps as shown in FIG. 1, comprising: a filter fusion bonding step (step S1) where the filter 14 is fused and bonded to the ink supply port 7; a porous member compression/insertion step (step S2) where the porous member 6 is inserted into the tank container 3 in a state of being compressed; a partition plate fusion bonding step (step S3) where the partition plate 4 is fused and bonded in the tank container 3; a first leakage checking step (step S4) where leakage from the gap between the partition plate 4 and the tank container 3 is checked; a cover fusion bonding step (step S5) where the cover member 12 is fusion bonded to the opening 25 of the tank container 3; a second leakage checking step (step S6) where leakage from the gap between the opening 25 of the tank container 3, and the cover member 12 is checked; and an ink injection step (step S7) where ink is injected into the ink containing chamber which is the second container chamber 9. Each of these steps is executed in the process of assembling the filter 14, the porous member 6, the partition plate 4, and the cover member 12 one after another on the tank container 3 being carried, while, for example, the tank container 3 is arranged to flow as a workpiece on an automatic assembling line.

Now, hereunder, these steps are described in detail one after another.

(Filter Fusion Bonding Step)

Figure 2:
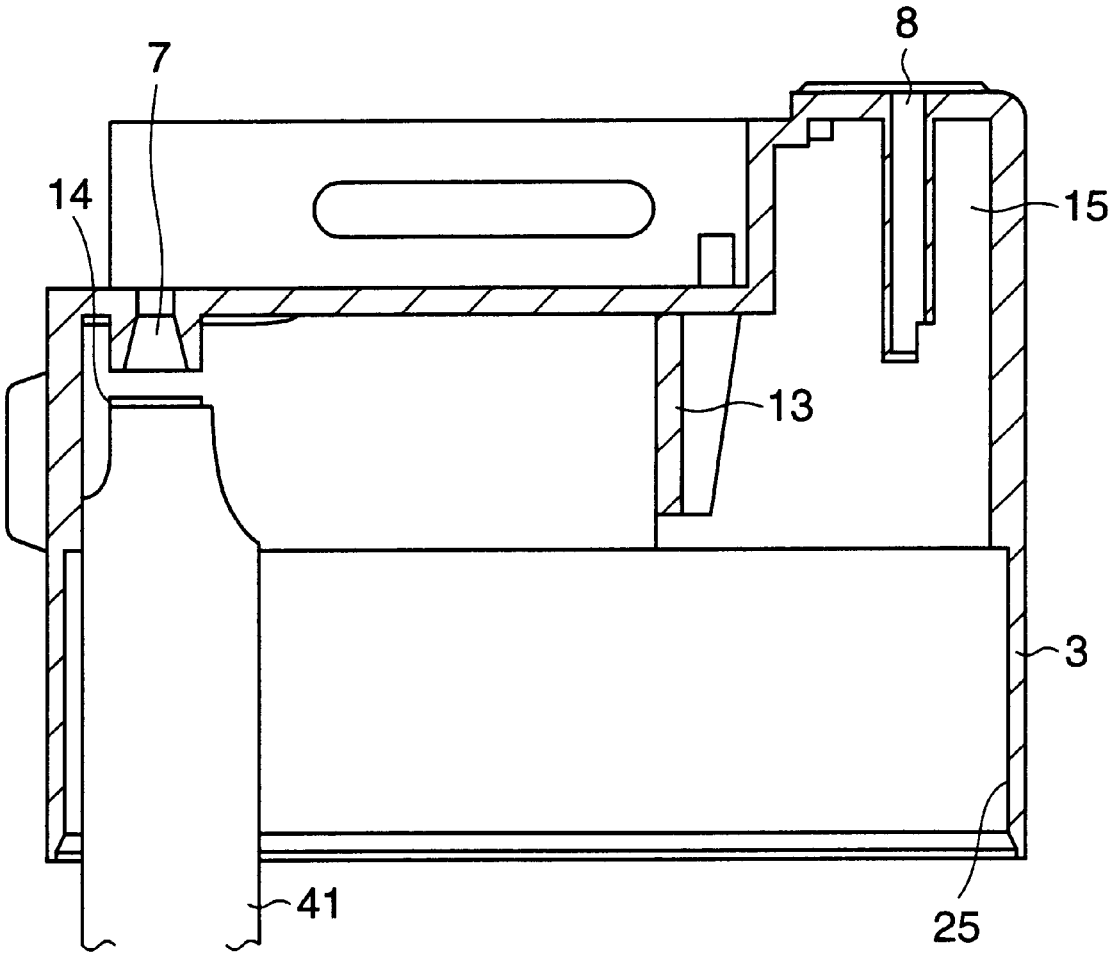
FIG. 2 is a cross-sectional view which shows a tank for the illustration of a filter welding process in accordance with one embodiment of the present invention.

FIG. 2 is a cross-sectional view which shows the tank in the filter fusion bonding step. In the filter fusion bonding step, the tank container 3 is carried with the opening 25 thereof downward as shown in FIG. 2. Then, with the filter 14 which is positioned in advance on a fusion bonding horn 41 installed with the leading end thereof being placed upward, and the tank container 3 which has been carried is moved over to the fusion bonding horn 41, thus thermally bonding the filter 14 to the ink supply port 7 provided for the inner wall of the tank container 3. Here, in this step, it becomes possible to suppress the positional variation of the filter 14 and the fusion bonding horn 41, because the fusion bonding horn 41 does not move.

(Porous Member Compression/Insertion Step)

Figure 3:
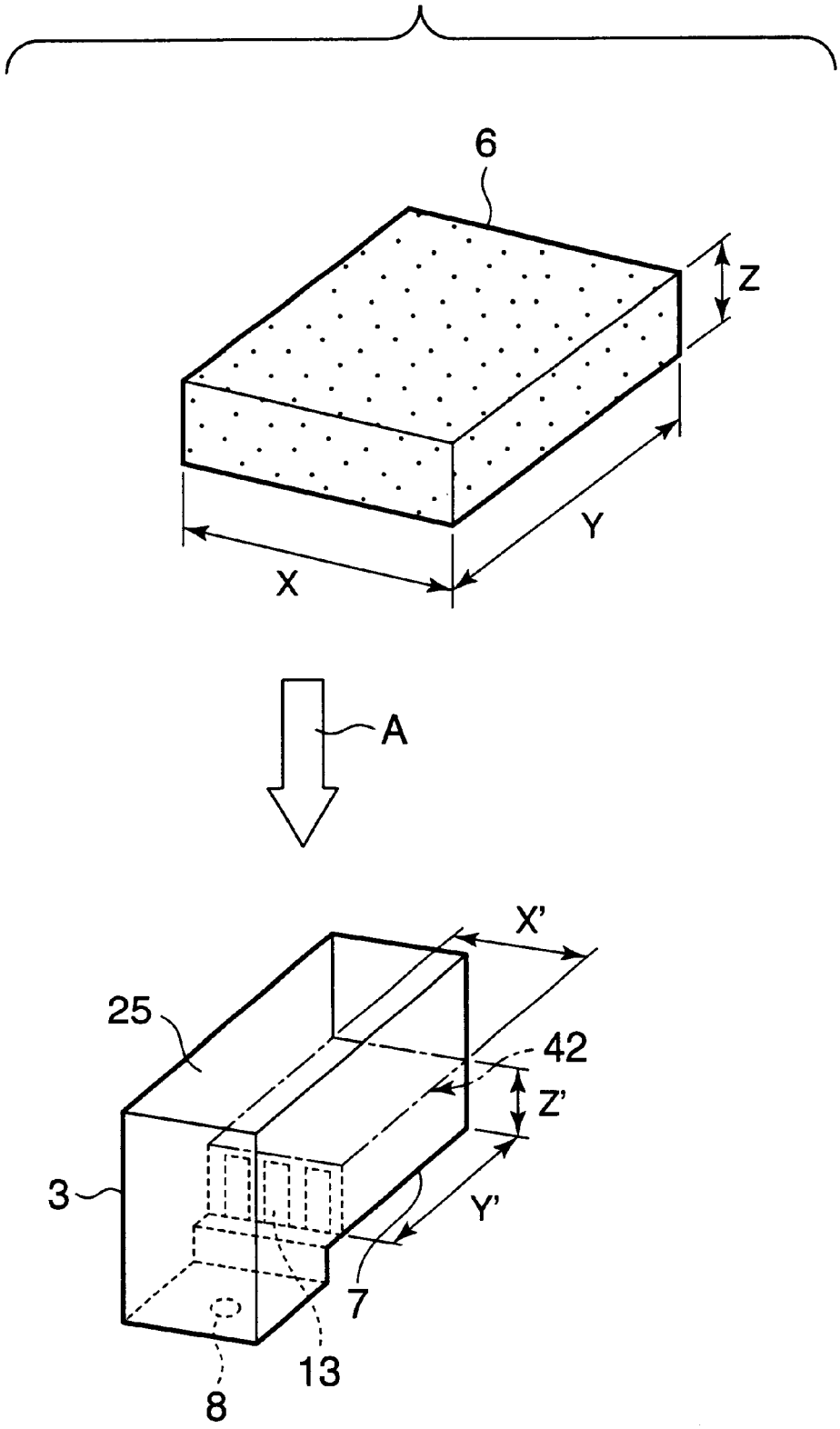
FIG. 3 is a perspective view which schematically shows the posture of a porous member inserted into a tank container in the compression/insertion process of the porous member in accordance with one embodiment of the present invention.

FIG. 3 is a perspective view which schematically shows the posture in which the porous member is inserted into the tank container in the porous member compression/insertion step. As shown in FIG. 3, the tank container 3 is installed on a jig with the opening 25 of the tank container 3 upward in the porous member compression/insertion step. Then, on the location 42 in the tank container 3 where the porous member is inserted, the flat rectangular parallelepiped porous member 6 is contained in a state of being compressed.

Before compression, the porous member 6 is in such a configuration that the dimension Z thereof in the inserting direction is extremely small as compared with the dimensions X and Y thereof in directions orthogonal to the direction A in which it is inserted into the tank container 3, and the dimensions X, Y, and Z of the porous member 6 after compression almost correspond to the dimensions X', Y', and Z' of the porous member 6 on the inserted location 42 shown in FIG. 3, but as to the dimension Z, there is almost no compression. For example, as shown in FIG. 17, whereas the dimensions X and Y before compression are 49 mm (24 mm after compression), and 55 mm (37 mm after compression), the dimension Z is 20 mm (14.5 mm after compression). The reason why the dimension Z is arranged not to be affected much by compression is that although the porous member should be compressed in order to generate negative pressure, there is a fear that the partition plate, which is fused and bonded later, is deformed by the restoring force of the compressed porous member if compression is exerted in the direction of dimension Z. However, compression is slightly exerted in the direction of the dimension Z in order to prevent the creation of gap between the partition plate 4 to be fused and bonded later, and the porous member 6 after having been contained.

Now, the specific example is described as to the method for compressing and inserting the porous member.

Figure 4A:
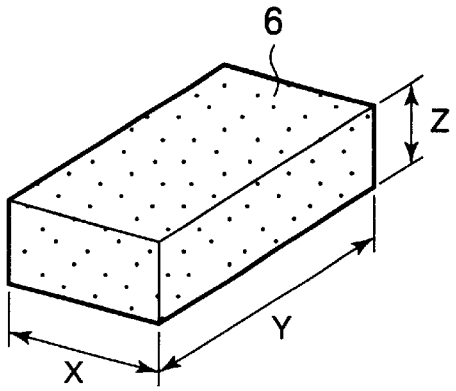
FIGS. 4A, 4B, 4C, 4D, 4E and 4F are views which schematically illustrate the operational flow of one example of the compression insertion method for the porous member to which one embodiment of the present invention is applicable.
Figure 4D:
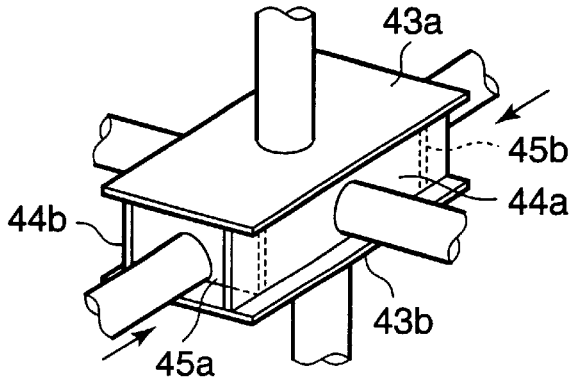
Figure 4B:
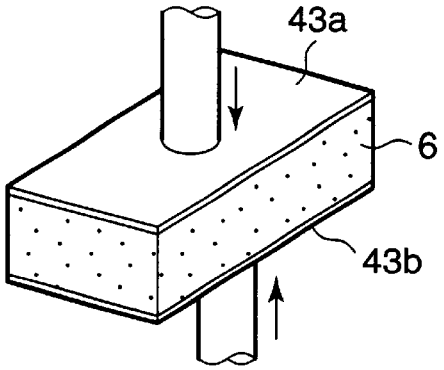
Figure 4E:
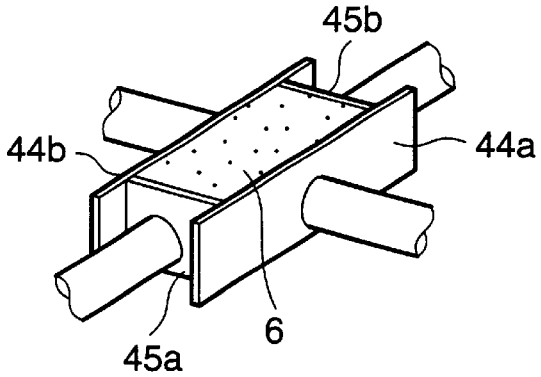
Figure 4C:
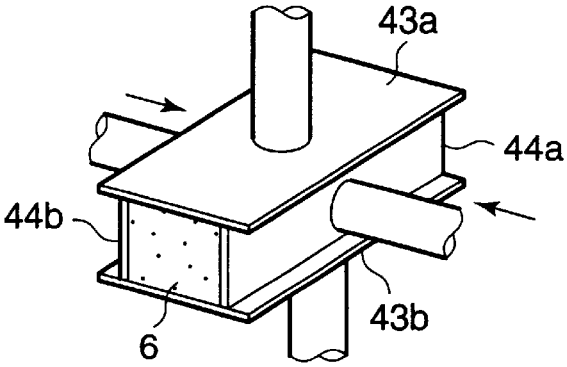

FIGS. 4A to 4F, and FIGS. 5A and 5B are views which schematically illustrate the operational flow of one example of the method for compressing and inserting the porous member 6. As shown in FIGS. 4A to 4F and FIGS. 5A and 5B, the porous member 6, which is in the state as shown in FIG. 4A, is pressed by pressure plates 43*a* and 43*b* to be clamped in the direction of the dimension z of the porous member 6 as shown in FIG. 4B. At this juncture, the porous member 6 is not compressed too much for the reason described earlier. Also, the reason why the porous member 6 is pressed despite not being compressed much is that as compared with the direction of the dimension Z, the dimensions X and Y of the porous member 6 are extremely large in the directions orthogonal to that direction in its shape, and that there is a fear that the porous member is folded in the direction of the dimension Z when it is compressed later in the directions of dimensions X and Further, as shown in FIG. 4C, the porous member 6 in the state of being nipped in the direction of the dimension Z is compressed between pressure plates 44*a* and 44*b* in the direction of the dimension X. Then, as shown in FIG. 4D, the porous member 6 is compressed between pressure plates 45*a* and 45*b* in the direction of the dimension Y of the porous member 6. For the present example, since the configuration is such that the dimension Y is larger than the dimension X, compression is exerted more in the direction of the dimension X than that of Y so that the compression density of the porous member is closer to being uniform after compression. Furthermore, compression is exerted in the order beginning with the shorter dimensions to stabilize the compressive condition.

Figure 4F:
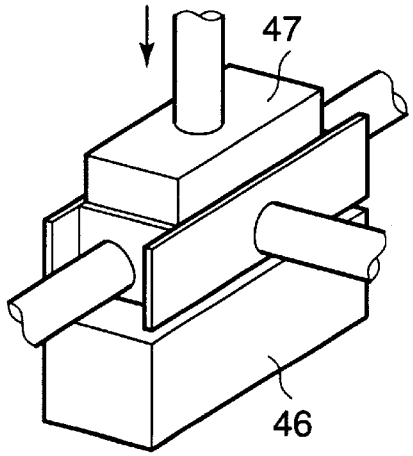

After that, as shown in FIG. 4E, the pressure plates 43*a* and 43*b* for the dimension Z are removed. Then, the porous member 6, which has been compressed in the directions of dimensions X and Y by the pressure plates 44*a*, 44*b*, 45*a*, and 45*b*, is pushed out by use of a pressure plate 47 as shown in FIG. 4F to be pressed in the casing member 46 having the contours to be fitted in the porous member insertion location 42, the dimensions of which are within those X' and Y' shown in FIG. 3.

Figure 5A:
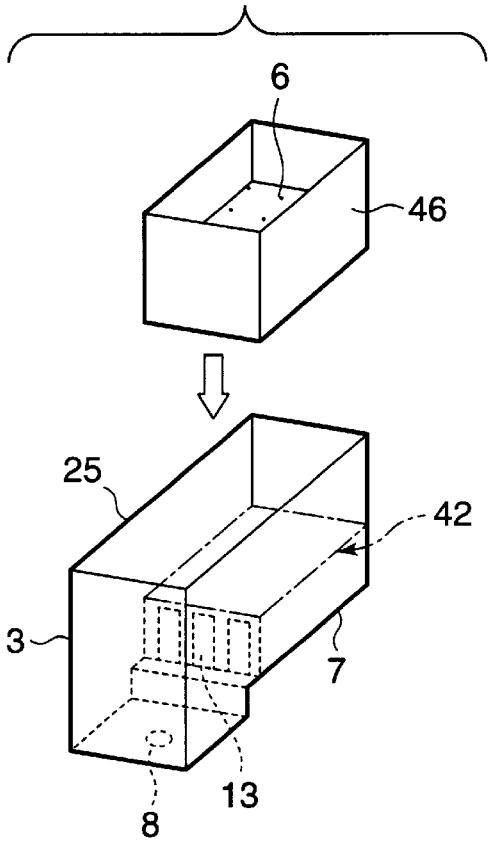
FIGS. 5A and 5B are views which schematically illustrate the operational flow of one example of the compression insertion method for the porous member to which one embodiment of the present invention is applicable, and continuously illustrate the operational state shown in FIGS. 4A to 4F.

Further, as shown in FIG. 5A, the tank container 3 is installed on a jig or the like with the opening 25 of the tank container 3 upward, and the casing member 46 that has kept the porous member 6 is inserted into the porous member insertion location 42 in the tank container 3.

Figure 5B:
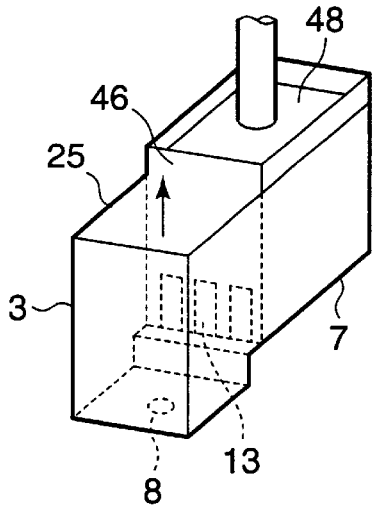

Lastly, as shown in FIG. 5B, the casing member 46 is withdrawn from the tank container 3 with the porous member 6 being conditioned to be pressed by the pressure plate 48. After that, the pressurized condition by the pressure plate 48 is released.

Figure 6:
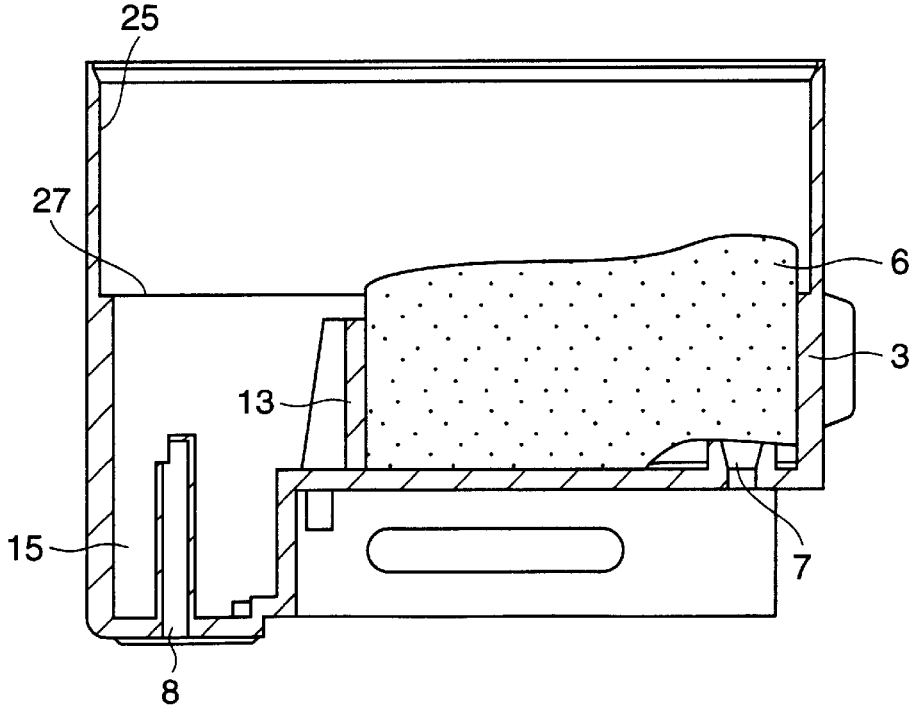
FIG. 6 is a cross-sectional view which shows the state of the tank after the completion of the porous member compression/insertion process in accordance with one embodiment of the present invention.

FIG. 6 is a cross-sectional view which shows the state of the tank after the completion of the porous member compression/insertion process as described above.

In this respect, such compression/insertion method as above has been described as a specific example, but it may be possible to apply the method proposed by the applicant hereof in the specification of Japanese Patent Laid-Open Application No. 07-314727 or the method disclosed in the specification of Japanese Patent Laid-Open Application No. 05-463. In accordance with the method proposed in the specification of the former Laid-Open Application, when a porous member is compressed and inserted by use of a hand for use of clamping, the inserted porous member has been already positioned on a designated inserting location in a tank container, and then, the hand for use of clamping is withdrawn with the porous member in such a state of being pressed as it is. As a result, there occurs a forcibly frictional relation between the porous member and the inner wall of the container, which makes it possible to contain the porous member in a more preferable condition without the occurrence of wrinkles, turning ups, or the like.

However, irrespective of any method that may be adopted, it is important to press a porous member as in the present invention so that it is not deformed in the direction in which it is inserted if the porous member is in a shape that the dimension thereof is extremely large in the direction orthogonal to the container inserting direction as compared with the one in the container inserting direction, and then, negative pressure is exerted by the greater compression on the dimension in the direction orthogonal to the container inserting direction, while scarcely compressing the dimension in the container inserting direction.

(Partition Plate Fusion Bonding Step)

Figure 7:
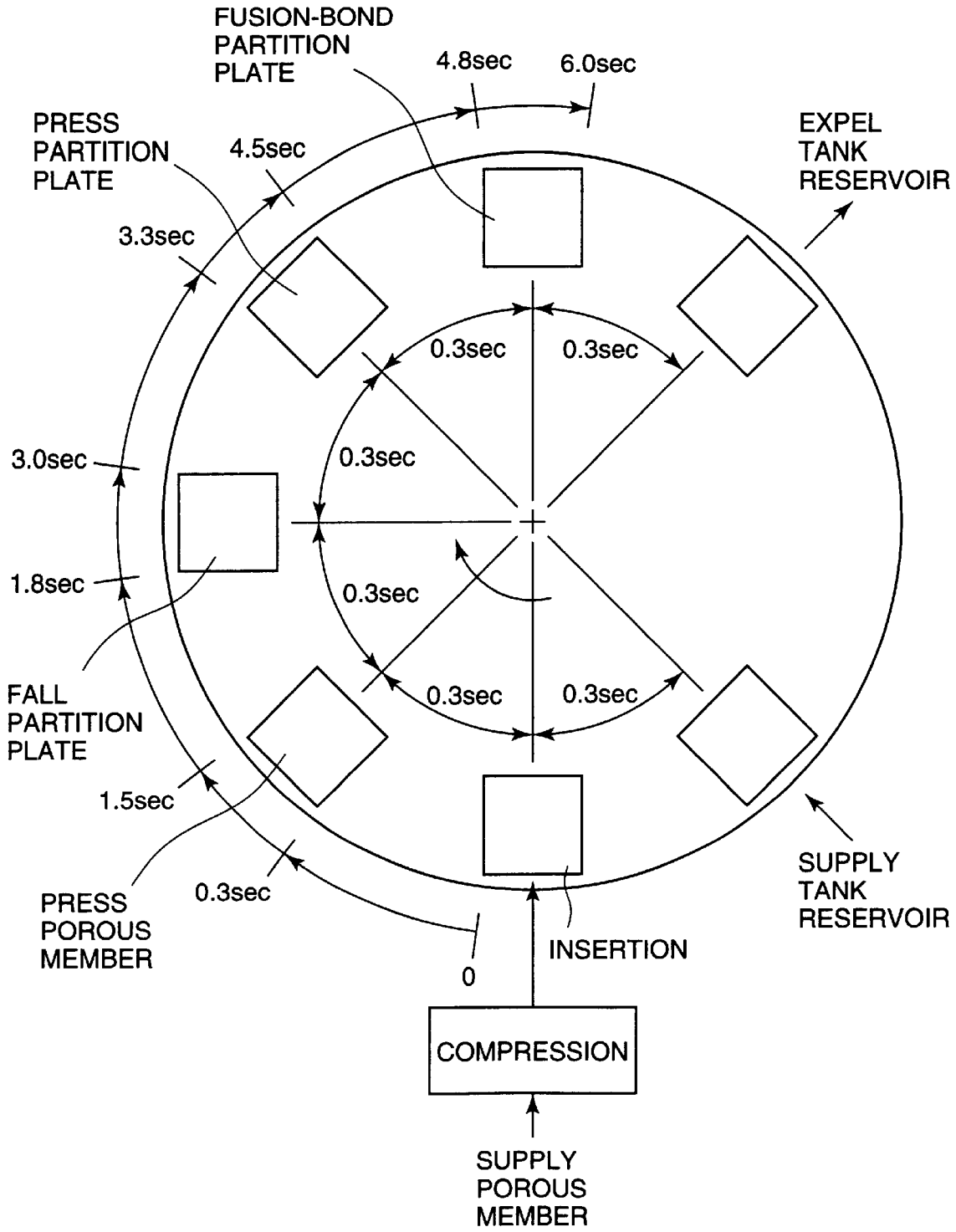
FIG. 7 is a view which shows the time schedule of each operation when the compression/insertion process for the porous member, and a partition plate fusion process are performed on a production line in accordance with one embodiment of the present invention.

FIG. 7 is a view which shows the time schedule for each of the operations to be executed in the porous member compression/insertion step and partition plate fusion bonding step on the line of manufacture. Also, FIG. 8 to FIG. 12 are cross-sectional views which illustrate the tank in each of the operational conditions in the partition plate fusion bonding step. Now, hereunder, in conjunction with FIG. 8 to FIG. 12, the description will be made of the partition plate fusion bonding step.

At first, the tank container 3 is fed and carried on the line of manufacture with the opening 25 thereof upward. After 0.3 second, the tank container 3 comes to a stop, and as described earlier, the step of compressing and inserting the porous member 6 is executed (see FIG. 6).

Figure 8:
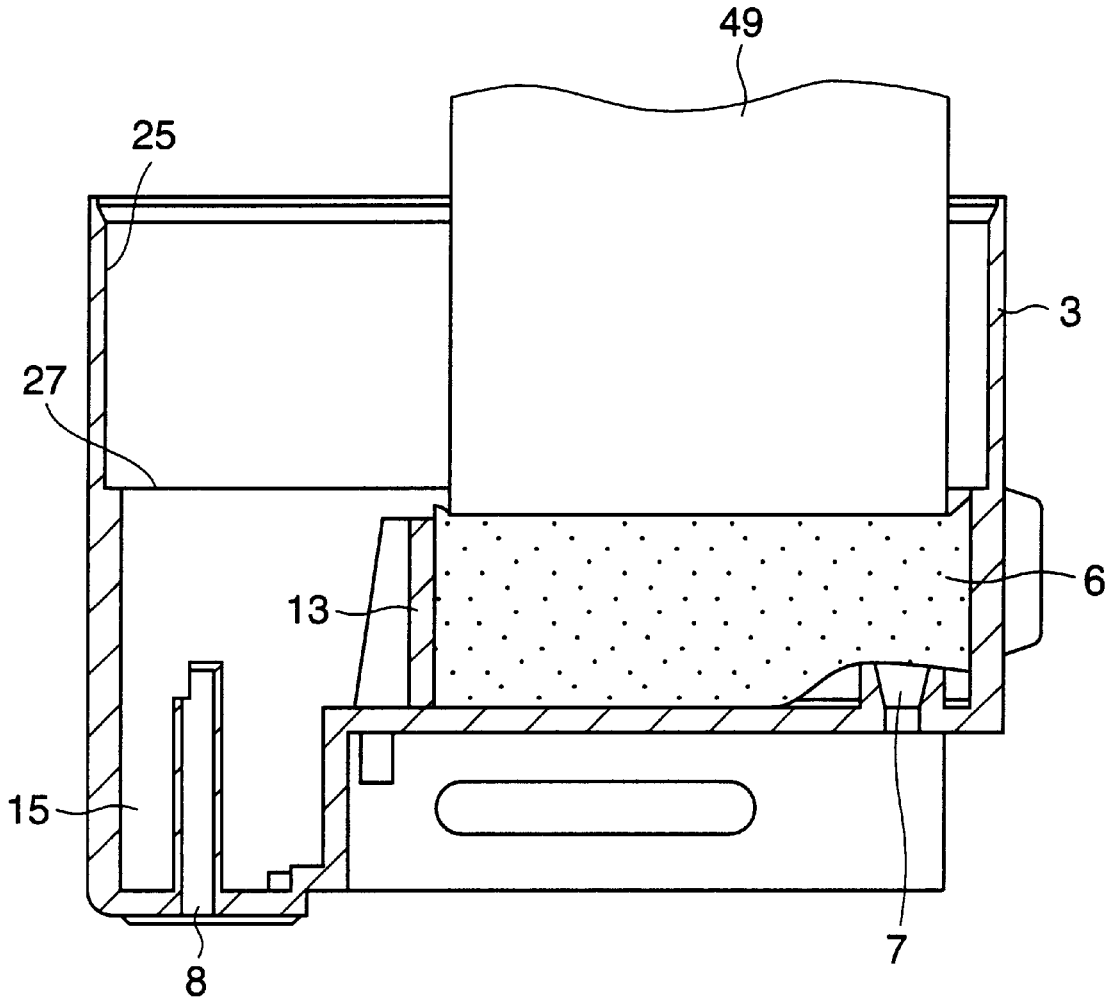
FIG. 8 is a cross-sectional view which shows the tank in the stage where the porous member is pressed in the partition plate fusion process in accordance with one embodiment of the present invention.

Then, the tank container 3 having the porous member 6 inserted completely is carried, and as shown in FIG. 8, the porous member 6 is pushed down by the pressure plate 49 lower than the fusion bonding section 27 when the tank container comes to a stop after 0.3 second.

Figure 9:
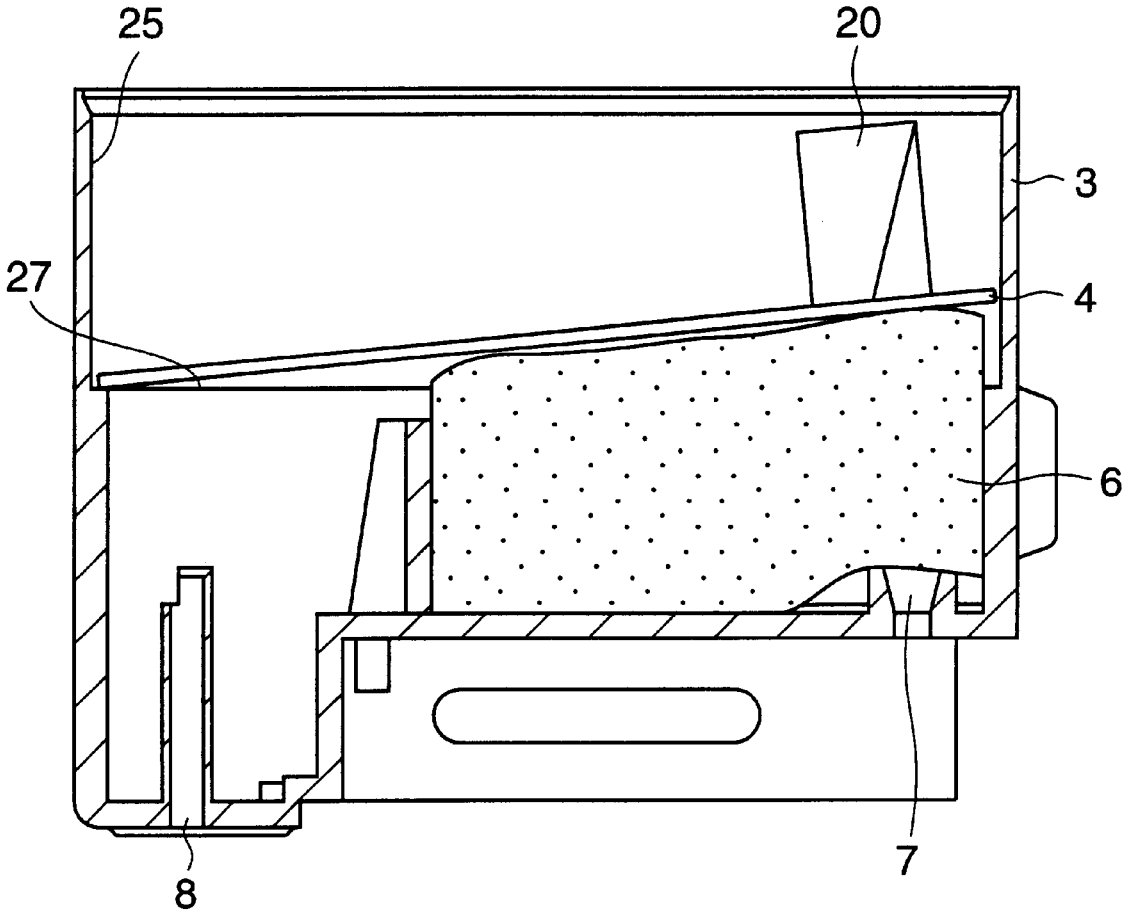
FIG. 9 is a cross-sectional view which shows the tank in the stage where the partition plate falls in the partition plate fusion process in accordance with one embodiment of the present invention.

Then, with the completion of pushing down of the porous member 6, the tank container 3 is carried. Here, it takes 1.2 second for the carrier that has come to a stop to push down the porous member, and begins to carry the tank container again. After 0.3 second since then, the tank container 3 comes to a stop again, and as shown in FIG. 9, the partition plate 4 is dropped down into the tank container 3.

Figure 10:
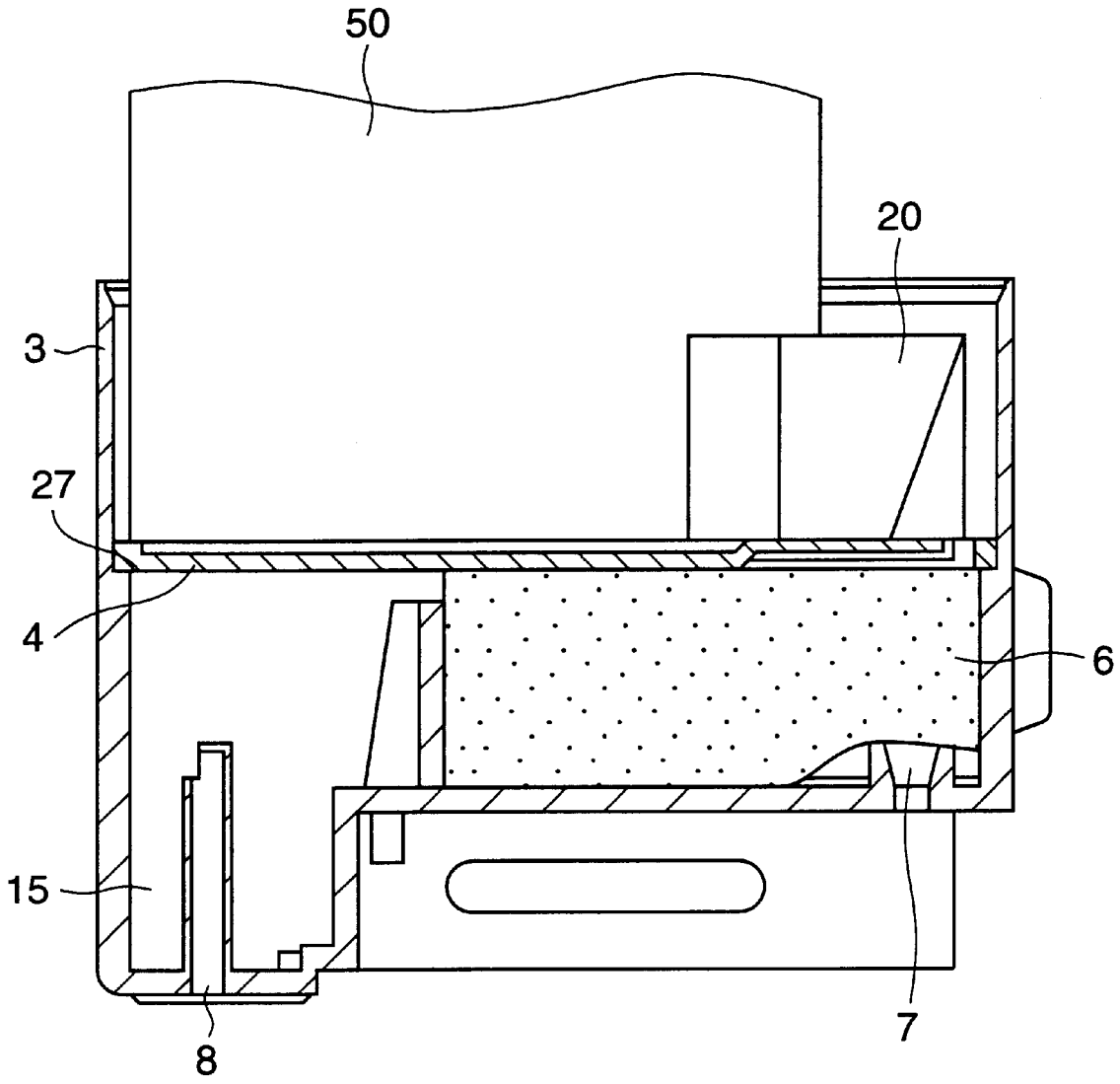
FIG. 10 is a cross-sectional view which shows the tank in the stage where the partition plate is pressed in the partition plate fusion process in accordance with one embodiment of the present invention.

Next, the tank container 3 having the partition plate 4 completely dropped thereinto is carried. Here, it takes 1.2 second for the carrier that has come to a stop to enable the partition plate to be dropped down, and begins to carry the tank container again. After 0.3 second since then, the tank container 3 comes to a stop again, and as shown in FIG. 10, the partition plate 4 is pressed by use of the pressure plate 50 until it is regulated in the fusion bonding section 27 in order to correct the posture of the partition plate 4 in the tank container 3. Here, it is desirable to arrange a configuration so that the pressure plate 50 can also press down the partition plate 4 from above the reflection plate 20 installed therefor.

Figure 11:
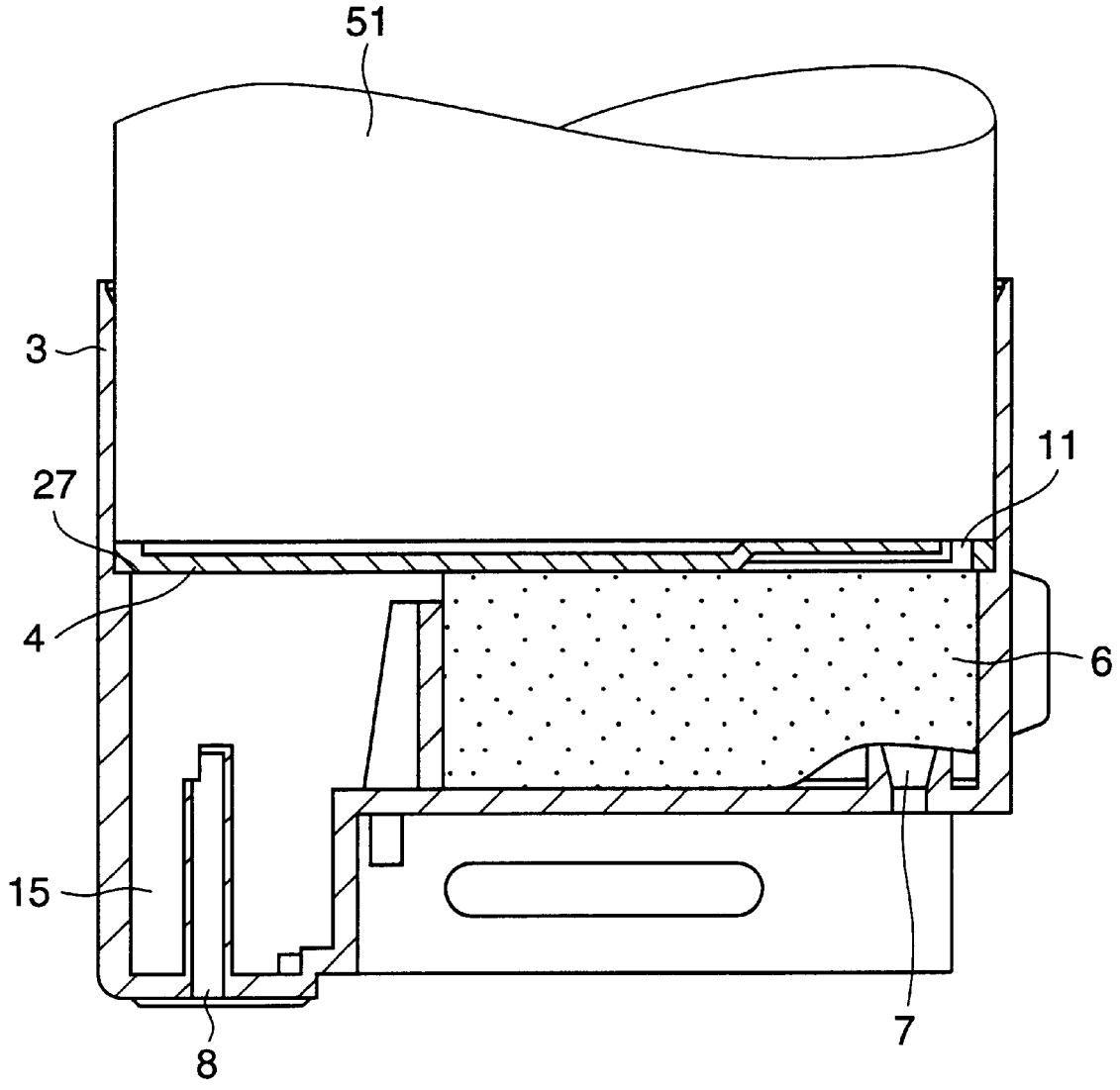
FIG. 11 is a cross-sectional view which shows the tank in the stage where the partition plate is fused in the partition plate fusion process in accordance with one embodiment of the present invention.

Next, the tank container 3 having the partition plate 4 completely pressed down is carried. Here, it takes 1.2 second for the carrier that has come to a stop to enable the partition plate to be pressed down, and begins to carry the tank container again. After 0.3 second since then, the tank container 3 comes to a stop again, and as shown in FIG. 11, the partition plate 4 is fused and bonded by use of the fusion bonding horn 51 for ultrasonic welding use to the fusion bonding section 27 of the tank container 3.

Figure 12:
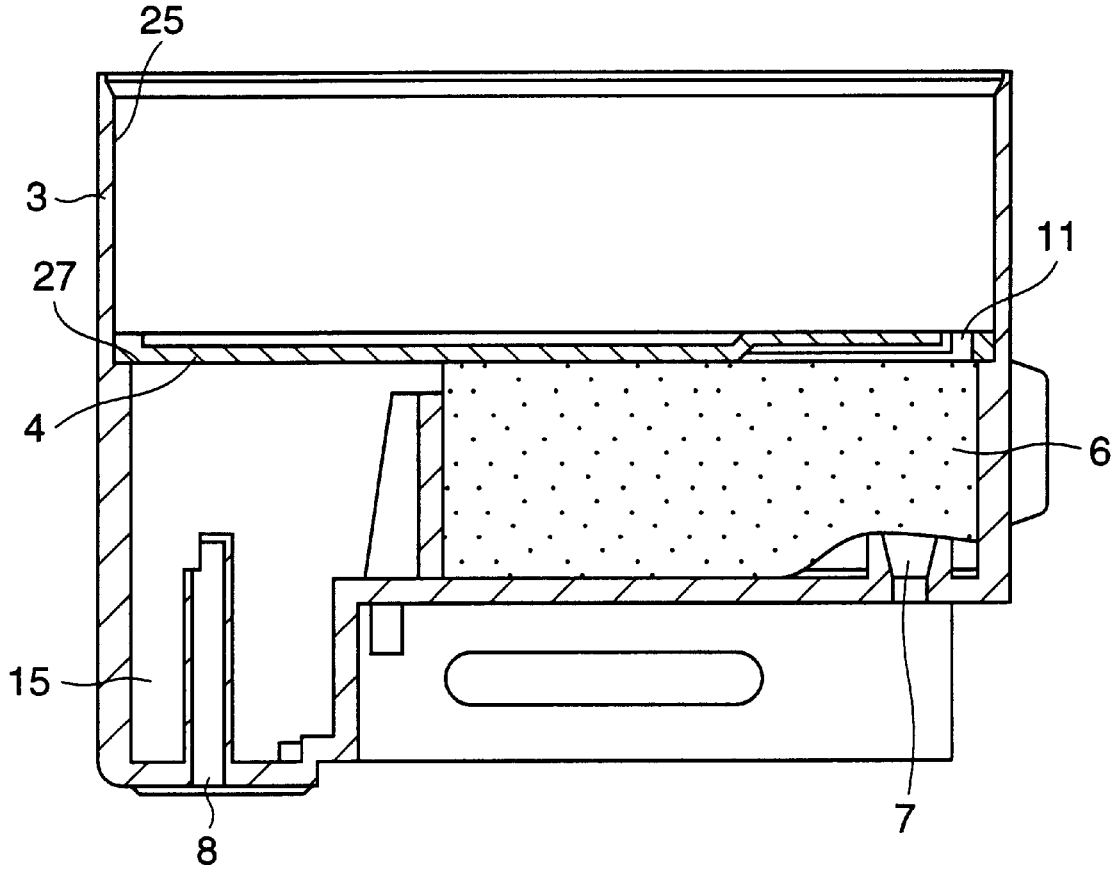
FIG. 12 is a cross-sectional view which shows the tank in the state after the completion of the partition plate fusion process in accordance with one embodiment of the present invention.

FIG. 12 is a cross-sectional view which shows the tank in a state after the completion of the partition plate fusion bonding step.

In the steps described above, the porous member, which has been inserted into the tank container in a state of being compressed, is once pushed thereinto during the period when the partition plate is fused and bonded. The reason why this is needed is that once the porous member 6 is expanded and folded as shown in FIG. 18 during the period before the partition plate 4 is fused and bonded after the porous member 6 has been inserted into the tank container 3, the folded condition remains unchanged as shown in FIG. 19 even if it should be pushed down for correction, which makes it impossible to obtain the appropriate compression under which the area existing between the fine communicative portion 11 and the ink supply port 7 is compressed more than the other area.

In accordance with the present embodiment, the fusion bonding is performed after the press down has been exercised once by use of the pressure plate 50, but the present invention is not necessarily limited thereto. It may be possible to perform the fusion bonding of the partition plate 4, while the porous member 6 being pressed down by use of the fusion bonding horn 51 through the partition plate 4 after the partition plate 4 has dropped down. In other words, it is important to press down the compressed porous member by a pressure jig, a partition plate, or the like before it is allowed to protrude.

(First Leakage Checking Step)

If the fusion bonding of the partition plate is insufficient in the previous step, the first container chamber 5 and the second container chamber 9 are allowed to communicate with each other in the location other than the fine communicative portion 11 in the ink tank thus completed. As a result, the gas-liquid exchange between the first container chamber (porous member containing chamber) 5 and the second container chamber (ink containing chamber) 9 is impeded, and the ink is not induced from the second container chamber 9 to the first container chamber 5 in good condition.

Therefore, in the first leakage checking step after the partition plate fusion bonding step, the ink supply port 7 and the fine communicative portion 11 are closed by use of plugs in the tank container 3 having the partition plate 4 fused and bonded therein as shown in FIG. 12. Then, the space on the first container chamber 5 side is pressurized with the air being sent in from the atmosphere communication port 8. Thus, the inner pressure of the space on the closed first container chamber 5 side is held for a period of 10 seconds when it has reached 147 kPa. After that, inspection is carried out through the atmosphere communicative part 8 to see whether or not the amount of pressure reduction of the inner pressure in the space of the closed first container chamber 5 side is a designated amount (0.068 kPa) or less. In this step, not only is pressurization applicable to the inspection, but also, decompression may be applicable. However, the inspection that uses pressurization makes it easier to find defects in the fusion bonding, because with pressurization, force is exerted in the direction of peeling of f the welded portion between the partition plate 4 and the tank container 3.

(Cover Fusion Bonding Step)

In the cover fusion bonding step, the cover member 12 is fused and bonded to the opening 25 of the tank container 3 by means of ultrasonic fusion bonding. FIG. 16A is a cross-sectional view which shows the tank in a state after the completion of the cover fusion bonding step.

(Second Leakage Checking Step)

If the fusion bonding of the cover member is insufficient in the previous step, ink leakage takes place in the ink injection step to be described later or in the completed ink tank.

Therefore, in the second leakage checking step after the cover fusion bonding step, pressurized inspection is executed as in the first leakage checking step. In other words, as shown in FIG. 16A, the entire body of the tank container 3 is pressurized with the air being sent from the atmosphere communication port 8 into the tank container 3 having the cover member 12 fused and bonded thereon, while closing the ink supply port 7 and the ink injection port 10 by use of plugs. Thus, the inner pressure of the closed tank container 3 is held for a period of 10 seconds when it has reached 147 kPa. After that, inspection is carried out through the atmosphere communicative port 8 to see whether or not the amount of pressure reduction of the inner pressure in the closed tank container 3 is a designated amount (0.068 kPa) or less.

(Ink Injection Step)

Figure 13:
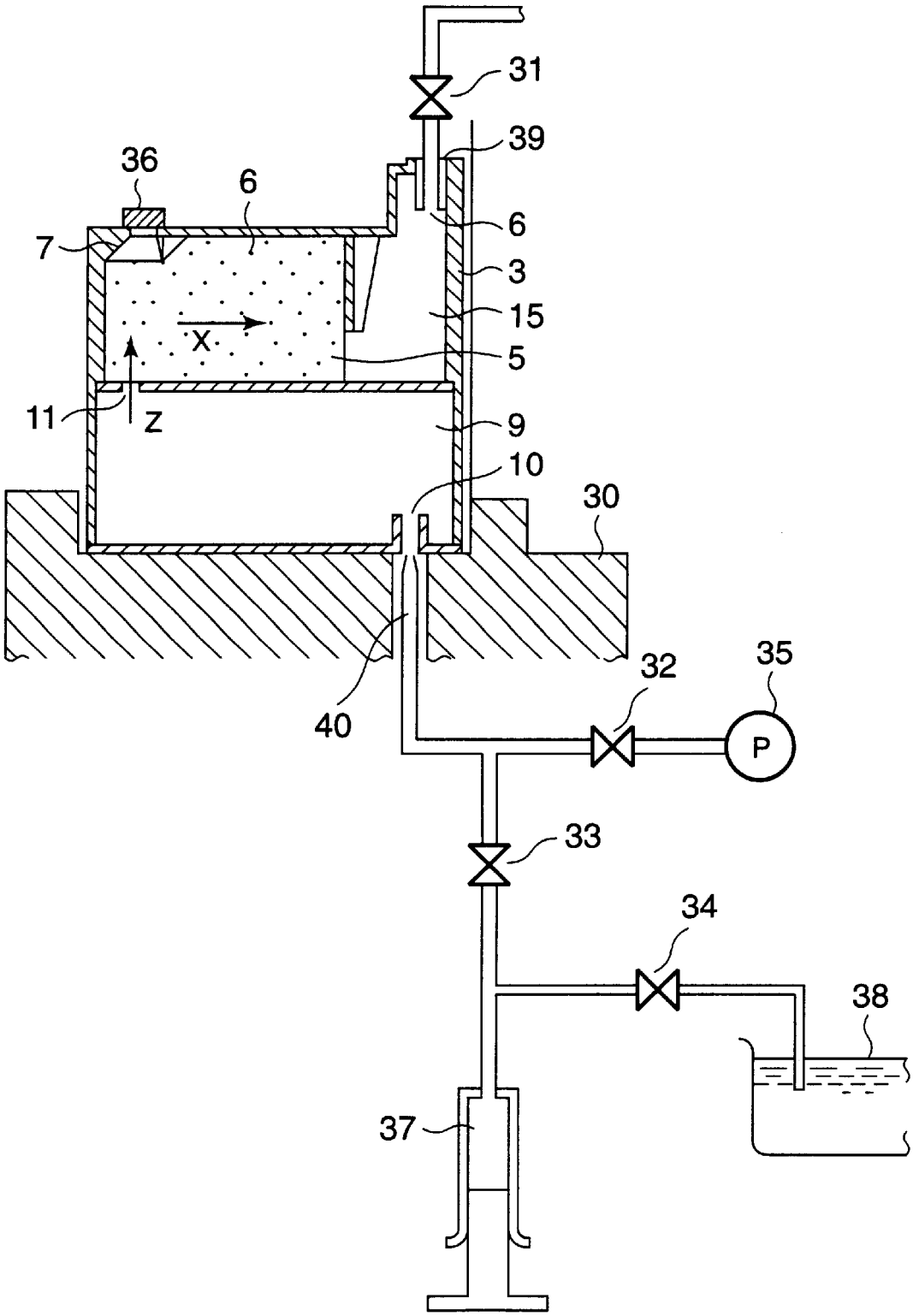
FIG. 13 is a view which schematically shows the structure of an apparatus used for ink injection process, and the condition in which the ink injection process is executed in accordance with one embodiment of the present invention.

The ink injection for the ink tank of the present embodiment is executed by the decompression method. FIG. 13 is a view which schematically shows the structure of an apparatus used for the ink injection step, and the executing condition of the ink injection step as well.

As shown in FIG. 13, the tank container 3 is set on a jig 30, and the atmosphere communication nozzle 39 is set at the atmosphere communication port 8, the plug 36, at the ink supply port 7, the exhaust/injection nozzle 40, at the ink filling port 10, respectively. The valve A31 and valve C33 are closed, while the valve B32 is open. Then, at the same time that exhaust is effectuated by the pump 35 sufficiently, the valve D34 is opened, and ink is filled from the ink pool 38 to the ink quantitative injection device 37 in a required amount. After the filling is finished, the valve D34 is closed, and then, when exhaust is effectuated sufficiently by the pump 35, the valve B32 is closed.

Subsequently, the valve C33 is opened, and the designated amount of ink is injected from the ink quantitative injection device 37 into the interior of the tank container 3. When this quantitative injection is completed, the valve C33 is closed immediately, and at the same time, the valve A31 is opened to release the negative pressure which still remains in the tank. Here, the steps from the one in which ink is injected into the tank container 3 to the one in which the valve A31 is opened to release the negative pressure remaining in the tank are executed almost continuously in order to avoid the ink in the tank, which tends to become equilibrated, from flowing out into the buffer chamber 15.

After all the steps so far have been taken, the valve A31 is closed again, and the exhaust/injection nozzle 40 is removed from the ink filling port 10. The ink filling port 10 is sealed with the SUS ball 10A. The atmosphere communication nozzle 39 is removed from the atmosphere communicative port 8. The plug 36 is removed from the ink supply port 7, and the tank container 3 is removed from the jig 30 to complete the ink injection step by the application of the decompression method.

With ink thus injected by means of decompression, the ink flow is not affected by gravitation, nor by the compression of the porous member. The ink flows in the direction Z in FIG. 13, and then, in the direction X, hence making it possible to facilitate filling ink sufficiently even in the area 6*a* which exists between the ink supply port 7 and the fine communicative portion 11 of the porous member 6. Also, this step is not necessarily limited to the adoption of the method using decompression injection. It may be possible to adopt the method that uses pressurized injection.

However, the injection method that uses decompression as described in the example hereof should be more preferable, because it becomes possible then to supply ink sufficiently to the area 6*a* where ink should be retained even when the ink that has no surfactant with lower permeability is to be used (usually, when black ink is used, no surfactant is contained in the composition thereof in order to make printed characters clearer by use of such ink).

(Other Embodiments)

Now, with reference to FIGS. 14A and 14B, and FIG. 15, the description will be made of the ink jet cartridge provided with the ink tank unit manufactured as described above, as well as the structural example of the ink jet recording apparatus that performs recording with such cartridge installed thereon.

Figure 14A:
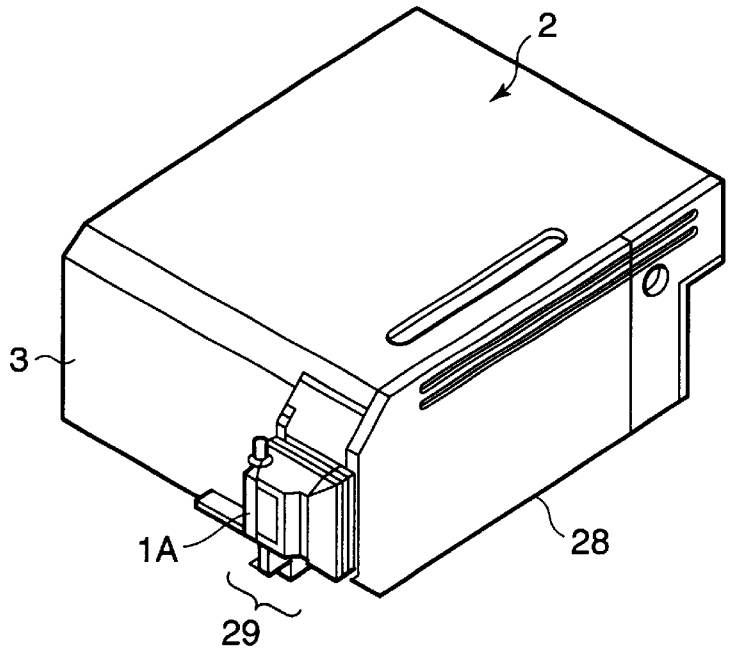
FIGS. 14A and 14B are perspective views which illustrate the structural example of an ink jet cartridge provided with the ink tank unit in accordance with one embodiment of the present invention.
Figure 14B:
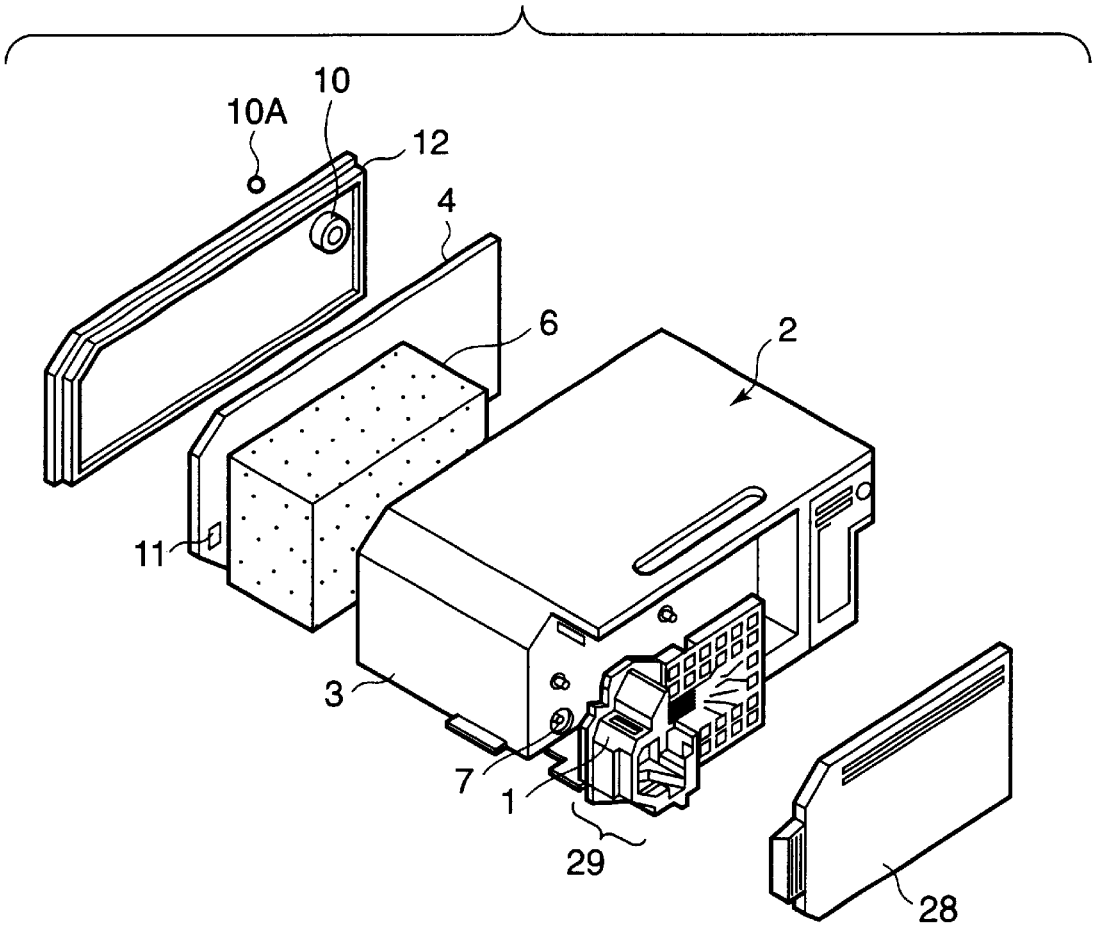

As clear from the perspective view shown in FIG. 14A, the ink jet cartridge of this example is in a shape in which the linear edge portion of the ink jet unit 29 slightly protrudes from the front face of the ink tank unit 2. As shown in FIG. 14B, the ink jet cartridge comprises the cover member 12; the SUS ball 10A that seals the ink filling port 10; the partition plate 4 provided with the fine communicative portion 11; the tank container 3 that contains the porous member 6 to retain ink (the porous member 6 shown in FIG. 14B represents its shape in the tank container 3 in a state of being compressed); the ink jet unit 29 for supplying ink from the ink supply port 7 provided for the tank container 3 to the ink jet recording head 1 through joint pipe (not shown), which is, at the same time, provided with the portion to transmit signals from the ink jet recording apparatus main body; and the head cover 28 that protects the ink jet unit 29.

In this respect, the ink jet recording head 1 performs recording by use of electrothermal converting devices that generate thermal energy for creating film boiling in ink in accordance with electric signals.

Figure 15:
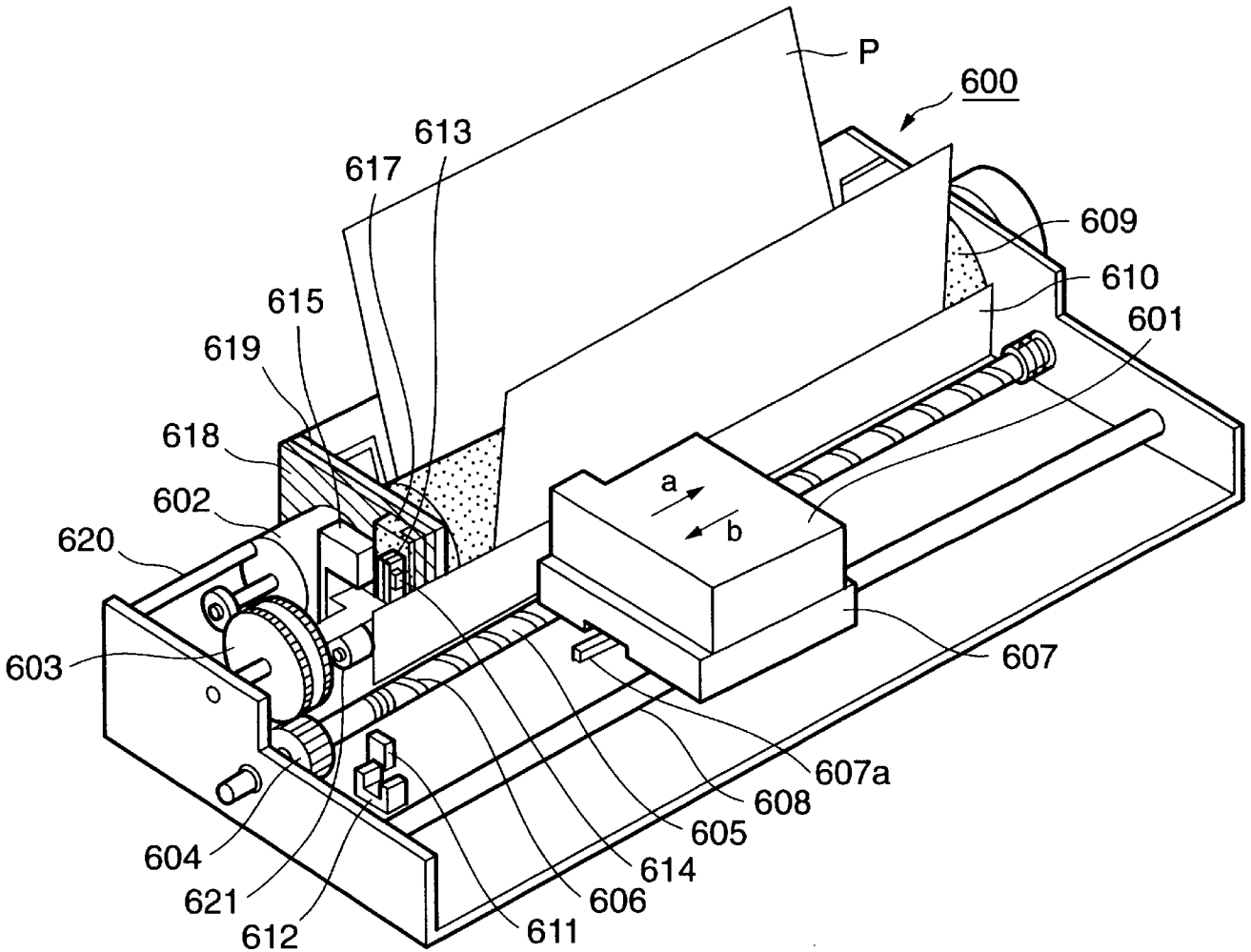
FIG. 15 is a view which schematically shows one structural example of the ink jet recording apparatus on which the ink jet cartridge represented in FIGS. 14A and 14B is installed for use.

FIG. 15 is a view which schematically shows one structural example of the ink jet recording apparatus to which the ink jet cartridge of the aforesaid structure is mounted and made applicable. For the ink jet recording apparatus 600 shown in FIG. 15, the ink jet cartridge 601 structured as above is mounted on the carriage 607 that engages with the spiral groove 606 of a lead screw 605 rotating through driving power transmission gears 603 and 604 which are interlocked with the regular and reverse rotations of a driving motor 602. The ink jet cartridge 601 reciprocates by the driving power of the driving motor 602 together with the carriage 607 along a guide 608 in the directions indicated by arrows a and b. The ink jet recording apparatus 600 is provided with recording medium carrying means (not shown) for carrying a printing sheet P serving as the recording medium that receives liquid, such as ink, discharged from the ink jet cartridge 601. Then, the sheet pressure plate 610, which is used for carrying the printing sheet P on a platen 609 by means for carrying recording medium, is arranged to press the printing sheet P to the platen 609 over the traveling direction of the carriage 607.

Photocouplers 611 and 612 are arranged in the vicinity of one end of the lead screw 605. The photocouplers 611 and 612 are the means for detecting home position which switches the rotational directions of the driving motor 602 by recognizing the presence of the lever 607*a* of the carriage 607 in the working region of the photocouplers 611 and 612. In the vicinity of one end of the platen 609, a supporting member 613 is arranged for supporting the cap member 614 that covers the front end having the discharge ports of the ink jet cartridge 601. Also, there is arranged the ink suction means 615 that sucks ink retained in the interior of the cap member 614 when idle discharges or the like are made from the ink jet cartridge 601. With the ink suction means 615, suction recoveries of the ink jet cartridge 601 are performed through the opening portion of the cap member 614.

For the ink jet recording apparatus 600, a main body supporting member 619 is provided. For this main body supporting member 619, a movable member 618 is movably supported in the forward and backward directions, that is, the direction at right angles to the traveling directions of the carriage 607. On the movable member 618, a cleaning blade 617 is installed. The mode of the cleaning blade 617 is not necessarily limited to this arrangement. Any known cleaning blade of some other mode may be applicable. Further, there is provided the lever 620 which initiates suction when the ink suction means 615 operates its suction recovery. The lever 620 moves along the movement of the cam 621 that engages with the carriage 607. The movement thereof is controlled by known transmission means such as the clutch that switches the driving power of the driving motor 602. The ink jet recording controller, which deals with the supply of signals to the heat generating elements provided for the ink jet cartridge 601, as well as the driving controls of each of the mechanisms described earlier, is provided for the recording apparatus main body side, and not shown in FIG. 15.

For the ink jet recording apparatus 600 structured as described above, the aforesaid recording medium carrying means carries a printing sheet P on the platen 609, and the ink jet cartridge 601 reciprocates over the entire width of the printing sheet P. During this reciprocation, ink (recording liquid) is discharged from the liquid discharge head unit to the recording medium in accordance with the driving signals for recording when driving signals are supplied to the ink jet cartridge 601 from driving signal supply means (not shown).

For the recording medium which is used for a recording apparatus of the kind for the adhesion of liquid, such as ink, thereon, it is possible to use, as an objective medium, various kinds of paper and OHP sheets; plastic materials used for a compact disc, ornamental board, and the like; cloths; metallic materials, such as aluminum, copper; leather materials, such as cowhide, pigskin, and artificial leathers; wood materials, such as wood, plywood; bamboo materials; ceramic materials, such as tiles; and three-dimensional structure, such as sponge, among some others.

Also, as the recording apparatus hereof, the following are included: a printing apparatus for recording on various kinds of paper, OHP sheet, and the like; a recording apparatus for recording on plastic materials such as a compact disc, and other plastic materials; a recording apparatus for recording on metallic materials such as metallic plates; a recording apparatus for recording on leather materials; a recording apparatus for recording on wood materials; a recording apparatus for recording on ceramic materials; and a recording apparatus for recording on three-dimensional netting structures, such as sponge, or a textile printing apparatus or the like that records on cloths.

Also, as discharging liquid usable for any one of these liquid discharge apparatuses, it should be good enough if only such liquid can be used matching with the respective recording mediums and recording conditions accordingly.

As described above, in accordance with the present invention, it becomes possible to insert the porous member into the tank container in good condition without causing the compressed porous member to be folded right on the center thereof even when the dimension of the porous member before insertion into the container is considerably small in the inserting direction as compared with the dimension in the direction orthogonal to the inserting direction, because when such porous member is inserted into the container, the porous member is clamped in the same direction as the aforesaid inserting direction, and then, compressed in such condition in the direction substantially orthogonal to the inserting direction.

Also, after the porous member has been inserted into the container in a state of being compressed, the porous member is once pushed in during the period when the partition plate is fixed to the opening of the container, and it becomes possible to prevent the porous member from being expanded and folded, hence obtaining appropriate compression in the porous member thus contained.

What is claimed is:

1. A method for manufacturing an ink tank comprising the steps of:

supplying a container having an opening;

inserting a porous member in an inserting direction into said opening of the container in a compressed state; and holding said porous member in the compressed state by fixing a plate member to said opening of the container, wherein said porous member is compressed more in a direction substantially orthogonal to the inserting direction when said porous member is inserted into said opening, and when compressing said porous member, said porous member is clamped in the same direction as the inserting direction so as not to allow said porous member to be deformed in the inserting direction, and in such state, said porous member is compressed in the direction substantially orthogonal to the inserting direction.

2. A method for manufacturing an ink tank according to claim 1, wherein before fixing said plate member to said opening, said porous member is pushed into said opening.

3. A method for manufacturing an ink tank according to claim 1, wherein said porous member is a flat rectangular parallelepiped having a smaller dimension in the inserting direction as compared with a dimension in the direction substantially orthogonal to the inserting direction of said porous member into said opening, and the dimension of said porous member in the inserting direction is slightly larger than the dimension of said opening in the inserting direction.

4. A method for manufacturing an ink tank according to claim 3, wherein said porous member is compressed more in a direction X orthogonal to the inserting direction than a direction Y also orthogonal to the inserting direction when the dimension of said porous member of flat rectangular parallelepiped shape is larger in the direction Y than the dimension in the direction X.

5. An ink tank used for the method of manufacture according to any one of claims 1 to 4, wherein said plate member is a partition plate for dividing the interior of said container into a first container chamber, and a second container chamber, and said porous member is contained in said first container chamber, said first container chamber is provided with an ink supply port arranged on a plane facing said partition plate, and an atmosphere communication port, said partition plate is provided with a fine communicative portion in an area substantially facing said ink supply port, and an area of said porous member existing between said ink supply port and said fine communicative portion is held in higher compression than other areas of said porous member.

6. An ink jet cartridge comprising:

an ink jet head being bonded to the ink supply port of said ink tank according to claim 5.

7. An ink jet cartridge according to claim 6, wherein said ink jet head is provided with electrothermal converting devices for generating ink discharge energy.

8. An ink jet cartridge according to claim 7, wherein said ink jet head discharges ink from discharge ports by utilization of film boiling generated in ink by thermal energy applied by said electrothermal converting devices.

9. An ink jet recording apparatus provided with an ink jet cartridge according to claim 6, wherein said ink jet cartridge is detachably mountable on a recording apparatus main body.

* * * * *

UNITED STATES PATENT AND TRADEMARK OFFICE

CERTIFICATE OF CORRECTION

PATENT NO. : 6,435,675 B2
DATED : August 20, 2002
INVENTOR(S) : Okura et al.

It is certified that error appears in the above-identified patent and that said Letters Patent is hereby corrected as shown below:

Column 1,
Line 8, “in” (first occurrence) should be deleted.

Column 8,
Line 48, “gap” should read -- a gap --.

Column 9,
Line 2, “and” should read -- and Y. --.

Column 12,
Line 49, the right margin should be closed up; and
Line 50, the left margin should be closed up.

Signed and Sealed this

First Day of April, 2003

JAMES E. ROGAN
*Director of the United States Patent and Trademark Office*